US006343437B1

(12) United States Patent
Hoffmann et al.

(10) Patent No.: US 6,343,437 B1
(45) Date of Patent: Feb. 5, 2002

(54) DOOR DRIVE WITH INTEGRATED DIAGNOSIS OF THE DOOR OPERATION

(75) Inventors: Klaus Hoffmann, Seeheim-Jugenheim; Andreas Etzel, Frankfurt, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/603,617

(22) Filed: Jun. 26, 2000

(30) Foreign Application Priority Data

Jun. 26, 1999 (DE) ..... 199 29 455

(51) Int. Cl.[7] ..... E05F 11/12
(52) U.S. Cl. ..... 49/363
(58) Field of Search ..... 49/360, 362, 363, 49/324

(56) References Cited

U.S. PATENT DOCUMENTS 3,922,814 A * 12/1975 Ruft ..... 49/363 X
3,936,977 A * 2/1976 Ruft et al. ..... 49/363 X
4,057,934 A * 11/1977 Okubo et al. ..... 49/363 X
4,125,966 A * 11/1978 Penn ..... 49/363 X
4,231,192 A * 11/1980 Daugiras et al. ..... 49/363
5,085,004 A * 2/1992 Beauprez ..... 49/363 X

FOREIGN PATENT DOCUMENTS

DE 19540620 A1 5/1997
DE 19828393 A1 1/1999

* cited by examiner

*Primary Examiner*—Jerry Redman
(74) *Attorney, Agent, or Firm*—Venable; Norman N. Kunitz

(57) ABSTRACT

A sliding door (B) that is operated with a door drive is moved with the aid of a lever arm (A) that is driven by a motor (M) via a gear. The end positions of the door, as well as two intermediate positions, are detected with mechanical switches (C) that are actuated by a cam disk (K). The mechanical switches (C) form a redundant safety system and, if necessary, can be omitted. A non-contacting sensor (S) is used independent of the mechanical switches (C). For the purpose of detecting the position, the sensor can fully replace the mechanical switches (C) and the cam disk (K) for actuating these switches. With the aid of a transmitting wheel (D) and the sensor (S), it is possible to draw a conclusion relating to the rotational speed as well as the door position. A central data processing unit (CPU) permits the control and adjustment of the door drive. A diagnostic evaluation of the door drive with respect to required maintenance operations is furthermore possible with the central data processing unit (CPU).

4 Claims, 1 Drawing Sheet

DOOR DRIVE WITH INTEGRATED DIAGNOSIS OF THE DOOR OPERATION

CROSS REFERENCE TO RELATED APPLICATION

This application claims the priority of German patent Application No. 19929455.0-23 filed Jun. 26, 1999, which is incorporated herein by reference.

BACKGROUND OF THE INVENTION

The invention relates to a door drive, including a diagnostic method, for controlling and adjusting a sliding door. More particularly, the present invention relates to a door drive for a sliding door, which generally comprises an electrically driven motor that operates a rotating lever arm via a gear, and means for detecting the door position by means of a motor control which controls the door speed in dependence on its position, and includes a central data processing unit in which at least one movement profile for the sliding door is stored.

A device for operating a sliding door is known from German Patent 198 28 393 A1. The door drive consists of an electric motor, which opens or closes a sliding door with the aid of a gear and an electromagnetic clutch with belt drive. The sliding door position is determined with a door-position detection device that is not described further herein. Near its two end positions, the sliding door is accelerated or decelerated with a constant gradient. During the start-up, the door is initially accelerated constantly until it reaches a maximum speed and then moves at the same speed until it approaches one of its end positions. Deceleration reduces the door speed near one of its end positions, so that the end position can be reached with as little noise as possible. The door position detection device, which is not shown in further detail here, must then determine whether the end position has been reached, so that the sliding door can be slowed down early enough. Door position detection devices of this type are known from the prior art. They are composed of cam disks or cam plates that are connected to the drive shaft of the door drive and activate different pressure-reaction switches, depending on the respective position of the cam disk. Depending on their position, these switches indicate where the sliding door must at least be located. Six (6) different positions can thus be determined for the sliding door, for example, with 6 pressure-reaction switches. However, a determination of the exact position over the complete moving distance of the sliding door is not possible with pressure-reaction switches of this type.

A door drive of the generic type is disclosed in German Patent 195 40 620 A1. The patent 195 40 620 A1 teaches the monitoring of a door movement by comparing a desired movement profile to an actual movement profile. However, the monitoring in this case is used for generating an interrupt signal for interrupting the movement if the desired movement and the actual movement deviate by a previously specified measure. The predetermined difference value, by which the actual value must deviate from the desired value, only serves to signal the case of an obstacle. The German Patent 195 40 620 A1 discloses that interfering influences on the door movement, caused by soiling or aging of the mechanical parts of the door, are to be taken into account through regular maintenance intervals. The desired movement must be recorded anew time and again because of these maintenance intervals.

Thus, it is the object of the present invention to provide a diagnostic system for automatic sliding doors, with the aid of which deviations from the predetermined movement profile of the sliding door can be detected.

SUMMARY OF THE INVENTION

The above object generally is achieved according to the present invention by a door drive for a sliding door comprising: an electrically driven motor that drives a rotating lever arm via a gear, with the lever being coupled to the door for controlling the movement of the door; a transmitting wheel with graduations that is coupled to the lever arm for rotational movement therewith; at least one sensor that cooperates with the transmitting wheel to provide signals corresponding to the angular position of the lever arm, with the output signals of the sensor being fed to a processing unit for detecting the sensor signals to provide an output signal corresponding to a movement profile of the door. A central data processing unit is connected to receive the output signal of the processing unit, and provides output control signals to a control unit for the motor and to an output unit, with at least one desired movement profile for controlling the door operation via the control unit and the motor, and tolerance ranges that indicate the limits within which the measured movement profile for the door operates without problems, being stored in the central data processing unit. The central data processing unit comprises means for adding the stored tolerance ranges to the stored desired movement profile, and for comparing the resulting desired movement profile to the movement profile measured by the sensor (S) and provided by the processing unit, and for providing an error signal to the output unit, to issue an error message if the measured movement profile for the sliding door (B) is outside of the tolerance ranges for the desired movement profile.

Note that the difference value between actual movement and desired movement provided according to the above described prior art reference DE 195 40 620 A1 therefore cannot be compared to the tolerance range utilized according to the present invention. That is, according to the present invention, if the tolerance range is exceeded only an error message is issued. This does not adversely affect the operation of the door. On the other hand, with the door drive according to German patent DE 195 40 620 A1, a soiling or wear of the door will prevent the closing of the door.

According to the present invention, an automatic door is moved with the aid of a lever arm that is operated by a motor and a gear. The end positions of the door, as well as two intermediate positions, are detected with mechanical switches operated by a cam disk. The mechanical switches form a redundant safety system and can, if necessary, be omitted. Independent of the mechanical switches, a non-contacting optical position sensor is used, which consists of a toothed wheel with rectangular gear profile and an optical sensor with transmitter and receiver. For the purpose of detecting the position, the optical position sensor can completely replace the mechanical switches and the cam disk for activating these switches. A toothed wheel with rectangular tooth profile constitutes the transmitting wheel for the optical position sensor. It is possible to reach a conclusion concerning the speed as well as the door position by measuring the distance between the transmitting wheel and the optical position sensor. The rectangular toothed-wheel profile advantageously permits a digital signal evaluation of the optical signals.

Other transmitting wheel designs that are familiar to the person skilled in the art can also be provided. The transmitting wheel is a disk provided with graduations. The graduations can preferably be detected and recognized with the aid of optical devices. Examples for graduations of this type are color markings, mirror coatings, perforated disks, toothed disks, disks with reflective surfaces, disks with reflective prisms and the like.

According to another embodiment according of the invention, the transmitting wheel and the position sensor can be configured as a magnetic sensor system. For that embodiment, the position sensor is a magnetic sensor and the transmitting wheel is provided with magnetically effective graduations, which are known to the person skilled in the art.

The primary advantage achieved with the invention is the simultaneous detection of door position and movement speed of the sliding door, which permits the detection of the complete movement profile of the sliding door. The detected movement profile of the sliding door is compared in a connected data processing system with the predetermined desired movement profile. As a result, it is advantageously possible to recognize the maintenance state of the sliding door without having to carry out a manual inspection.

The larger the fleet of vehicles that must be maintained and serviced by an operator, the higher the advantage of the automatic diagnosis, in particular for sliding doors in trains, street cars or buses.

An exemplary embodiment of the invention is illustrated in the drawings and is explained in detail below.

DETAILED DESCRIPTION OF THE PREFERRED EMBODIMENT

Figure 1:
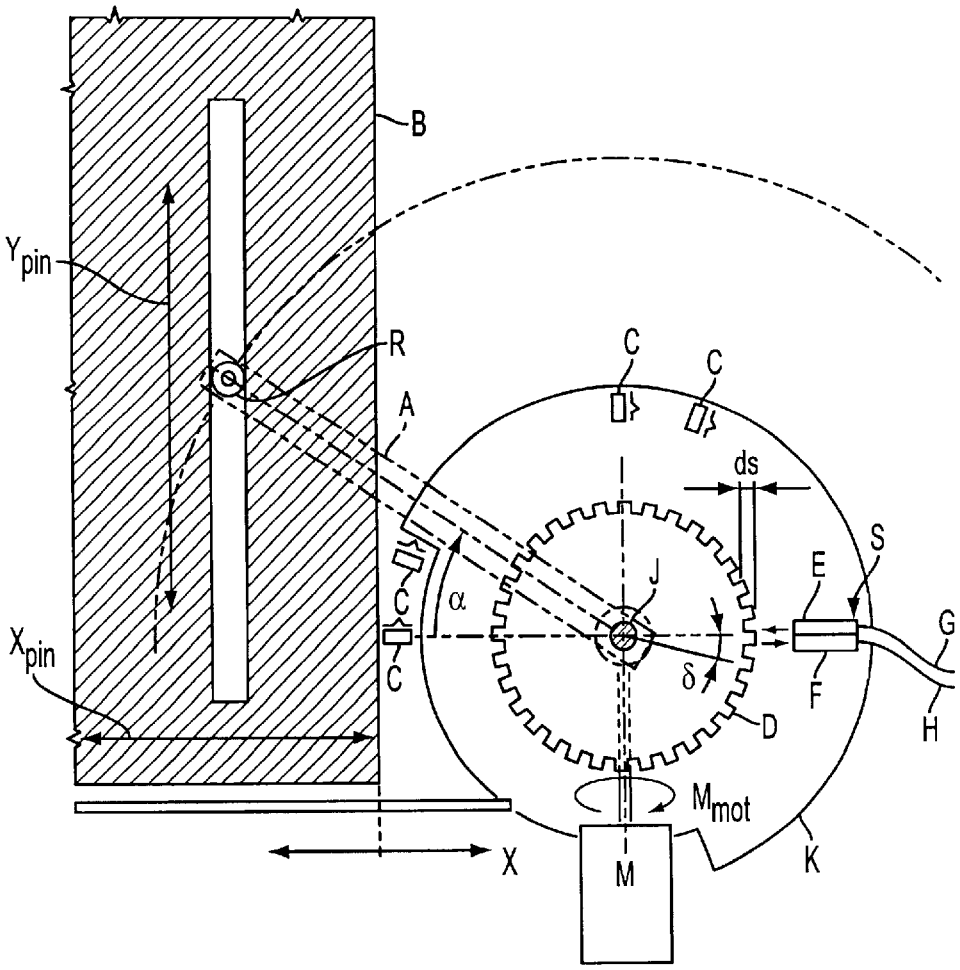
FIG. 1 is a schematic representation of a driven sliding door with an optical position sensor and a transmitting wheel in the shape of a toothed wheel.

FIG. 1 contains an example of an automatic sliding door (B) with the door drive according to the invention. The sliding door (B) can be moved by a lever arm (A) along a guide rail (X). For this, the circular movement of the lever arm (A) is converted to a translatory movement ($X_{PIN}$) by means of castors (R), which are positioned inside a groove (GR), such that they can be moved in the y-direction. The lever arm preferably is operated by an electric motor (M) and via a gear that is not shown here. The cam disk (K) and the transmitting wheel (D) are mounted concentrically on the locally fixed rotational axis (I) of lever arm (A). In a manner known per se, the cam disk activates mechanical switches (C), preferably pressure-reaction switches. The switches (C) are indicated only schematically. The mechanical switches (C) preferably constitute a redundant, additional safety system, which permits the continued operation of the sliding door if the optical position sensor should fail, for example, due to dirt accumulation. A separate mechanical switch preferably detects each respective one of the two end positions of the sliding door, either the completely closed or the completely open state. A respective one additional mechanical switch is connected in series in front of the end-position switches and detects the approach of the sliding door to the end position, so that the sliding door can be slowed down before reaching the end position. Of course, other safety switches that are not shown in further detail are necessary as well. These switches stop the door drive in a manner known per se, for example, if a passenger is caught in the door. The transmitting wheel (D) is designed as toothed wheel.

The toothed wheel of one preferred embodiment has a rectangular tooth profile. The rotational angle ($\alpha$) of the lever arm (A) is detected with the aid of a conventional optical position sensor (S), consisting of a transmitting part (E) and a receiving part (F). For this, the teeth of the transmitting wheel (D) that pass by the receiving part (F) are counted in the traditional way. The rectangular teeth of the toothed wheel in this case have the advantage of making a digital signal evaluation easier. The number of transmitting wheel teeth that pass by the optical sensor (S) represent a clear, fixedly correlated measure for the actual position of the sliding door (B), provided at least one of the end positions of the sliding door is known as a reference point. The optical sensor (S) is connected via the connecting lines (G, H) to a processing unit.

Figure 2:
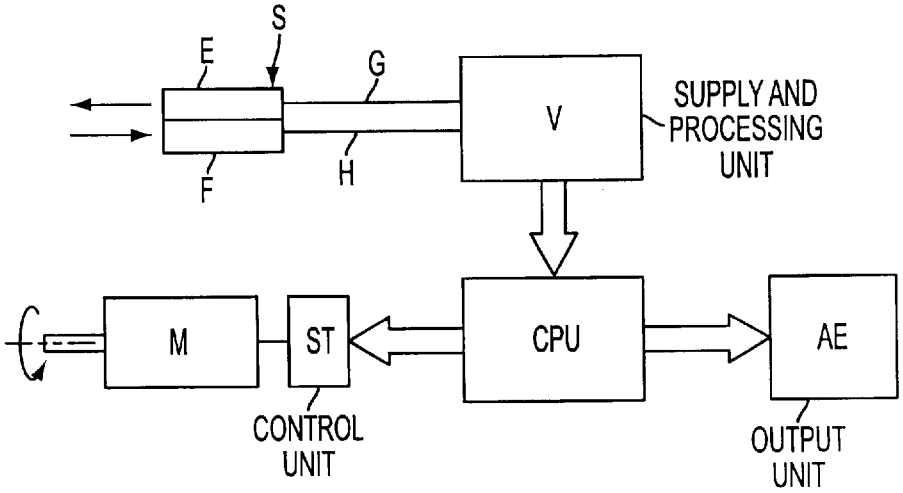
FIG. 2 is a schematic block diagram relating to diagnostic, control and adjustment of the automatic sliding door according to the invention.

FIG. 2 contains a schematic block diagram for the diagnosis, control and adjustment of the automatic sliding door. The optical sensor (S) is connected to a supply and processing unit (V). The supply and processing unit (V) on the one hand feeds light into the light-wave conductor (G) for supplying the transmitting part (E) and, on the other hand, receives the signals from the receiving part (F) via the light-wave conductor (H). The intensity of the reflected light that is received by the receiving part (F) fluctuates in dependence on the position of the transmitting wheel (D). If the reflected light comes from a raised tooth surface, then the intensity of the reflected light is high. If the reflected light comes from a gap between the teeth, the intensity of the reflected light is comparably low. Rectangular teeth are particularly advantageous for this because teeth of this type also provide rectangular signals, the edges of which are particularly easy to detect. The processing unit (V) comprises all of the necessary electronic converter circuits, counting circuits, display circuits and computing circuits, as well as devices for measuring the time. The received signal is scanned in the processing unit (V) and the rotational speed of the transmitting wheel (D) is thus determined with the aid the recurring edges. In the simplest case, this occurs by counting the number of edges per time unit that pass through.

With the embodiment according to the invention, it is possible to compute not only the door speed at a specific point in time, but also the door position at a specific point in time. The processing unit (V) then provides a speed/time profile as well as a distance/time profile in digital form to a central data processing unit (CPU). In the central data processing unit, the movement profile of the sliding door is produced from the speed/time diagram and the distance/time diagram. The movement profile for another embodiment can also be produced in the processing unit (V). That is to say, the processing unit (V) and the data processing unit (CPU) can be embodied as separate devices or can be components of a single, integrated unit. The CPU is furthermore connected to the control unit (ST) for controlling the motor (M) for the door drive and to an output unit (AE).

At least one movement profile for the sliding door is stored in the central data processing unit as predetermined, desired movement profile. This stored desired movement profile advantageously allows computing the control commands for the motor control unit (ST) of the door drive. For this, the sliding door (B) is opened and closed according to the stored movement profile. The stored movement profile is therefore used to control the door operation with the aid of the central data processing system.

The actual movement profile of the sliding door is simultaneously detected via the optical sensor (E), so that the previously described door control if necessary can be used for adjusting the door operation. Based on the evaluation of the desired value/actual value comparison between the actually measured movement profile and the stored desired movement profile, it is possible to make corrections by adjusting the actuation of the door drive.

Tolerance ranges for the movement profile can advantageously be added to the desired movement profile of the sliding door. The tolerance ranges indicate within which boundaries the movement profile for the sliding door operates smoothly or is considered non-problematic. The tolerance ranges are also stored in the central data processing unit (CPU). For the preferred embodiment, it is furthermore checked in the central data processing unit whether or not the measuring points from the actually measured movement profile are in the tolerance range. If the actual movement profile is outside of the tolerance range, an error message is stored in the output unit (AE) or is printed out as hard copy. Thus, the door drive is provided with a diagnostic unit, which indicates whether the door requires maintenance operations. Soiling, in particular, will cause errors in the movement profile of the sliding door.

The invention now being fully described, it will be apparent to one of ordinary skill in the art that many changes and modifications can be made thereto without departing from the spirit or scope of the invention as set forth herein.

What is claimed is:

1. A door drive for a sliding door (B) comprising: an electrically driven motor (M) that drives a rotating lever arm (A) via a gear, with the lever being coupled to the door for controlling the movement of the door; a transmitting wheel (D) with graduations coupled to the lever aim for rotational movement therewith; at least one sensor that cooperates with the transmitting wheel to provide signals corresponding to the angular position of the lever arm, with output signals of the sensor being fed to a processing unit (V) for detecting the sensor output signals to provide an output signal corresponding to a measured movement profile of the door; and a central data processing unit (CPU), which is connected to receive the output signal of the processing unit (V), and provide output control signals to a control unit (ST) for the motor (M) and to an output unit (AE), with at least one desired movement profile for controlling the door operation via the control unit (ST) and the motor (M), and tolerance ranges that indicate the limits within which the measured movement profile for the door operates without problems, being stored in the central data processing unit (CPU), with the central data processing unit comprising means for adding the stored tolerance ranges to the stored desired movement profile to provide a resulting desired movement profile, and for comparing the resulting desired movement profile to the measured movement profile measured by the sensor (S) and provided by the processing unit, and for providing an error message to the output unit (AE) if the measured movement profile for the sliding door (B) is outside of the tolerance ranges for the desired movement profile.

2. A door drive according to claim 1, wherein the transmitting wheel is provided with optically effective graduations.

3. A door drive according to claim 1, wherein the transmitting wheel is provided with magnetically effective graduations.

4. A door drive according to claim 1, wherein mechanical switches (C) for detecting at least end positions of the door movement are provided in addition to the sensor (S), with the switches being activated with a cam disk (K) mounted for rotation with the transmitting wheel.

* * * * *